US008616490B2

(12) United States Patent
Blok

(10) Patent No.: US 8,616,490 B2
(45) Date of Patent: Dec. 31, 2013

(54) HAND DISPENSER FOR STRETCH WRAP

(75) Inventor: Johannes Blok, Perth Amboy, NJ (US)

(73) Assignee: Broadway Kleer-Guard Corp., Monroe, NJ (US)

( * ) Notice: Subject to any disclaimer, the term of this patent is extended or adjusted under 35 U.S.C. 154(b) by 521 days.

(21) Appl. No.: 12/930,846

(22) Filed: Jan. 18, 2011

(65) Prior Publication Data

US 2012/0181369 A1 Jul. 19, 2012

(51) Int. Cl.
*B65D 85/02* (2006.01)

(52) U.S. Cl.
USPC ..... 242/588.2; 242/588.6; 242/422.4; 242/405.3

(58) Field of Classification Search
USPC ..... 242/588–588.3, 588.6, 422, 422.4, 405, 242/405.3
See application file for complete search history.

(56) References Cited

U.S. PATENT DOCUMENTS

| | | | | |
|---|---|---|---|---|
| 4,102,513 | A | 7/1978 | Guard | |
| 4,179,081 | A * | 12/1979 | Parry | 242/422.1 |
| 4,248,392 | A | 2/1981 | Parry | |
| 4,477,037 | A | 10/1984 | Goldstein | |
| 4,484,717 | A | 11/1984 | Goldstein | |
| 4,522,348 | A | 6/1985 | Strout | |
| 4,535,951 | A | 8/1985 | Riemenschneider, III | |
| 4,575,020 | A | 3/1986 | Strout | |
| 4,714,211 | A | 12/1987 | Hwang | |
| 4,722,493 | A | 2/1988 | Parry et al. | |
| 4,817,762 | A | 4/1989 | Powell | |
| 4,872,623 | A * | 10/1989 | Parry et al. | 242/422.4 |
| D317,394 | S | 6/1991 | Goldstein | |
| 5,094,395 | A | 3/1992 | Lambert | |
| 5,203,517 | A | 4/1993 | Parry | |
| 5,311,725 | A | 5/1994 | Martin et al. | |
| D382,429 | S | 8/1997 | Goldstein | |
| 5,915,642 | A | 6/1999 | Davis | |
| 5,941,049 | A | 8/1999 | Lancaster, III et al. | |
| 7,380,744 | B1 * | 6/2008 | Yu Chen | 242/422.4 |
| D612,179 | S | 3/2010 | Huang | |
| 7,726,600 | B2 | 6/2010 | Huang | |
| 2008/0072538 | A1 * | 3/2008 | Kohn et al. | 53/358 |
| 2009/0050729 | A1 | 2/2009 | Huang | |
| 2009/0308968 | A1 | 12/2009 | Piotrowski | |

* cited by examiner

*Primary Examiner* — William E Dondero
*Assistant Examiner* — Nathaniel Adams
(74) *Attorney, Agent, or Firm* — Philip M. Weiss; Weiss & Weiss

(57) ABSTRACT

A film dispenser for dispensing stretch wrap or other flexible materials. The film dispenser is comprised of a separate inner and outer mold. The inner mold is comprised of slots and extensions, and a collar which fits into the outer mold, and inner ridges of said inner mold fit into a groove on an extended core. The outer mold is comprised of ribs which fit into the slots of the inner mold.

20 Claims, 6 Drawing Sheets

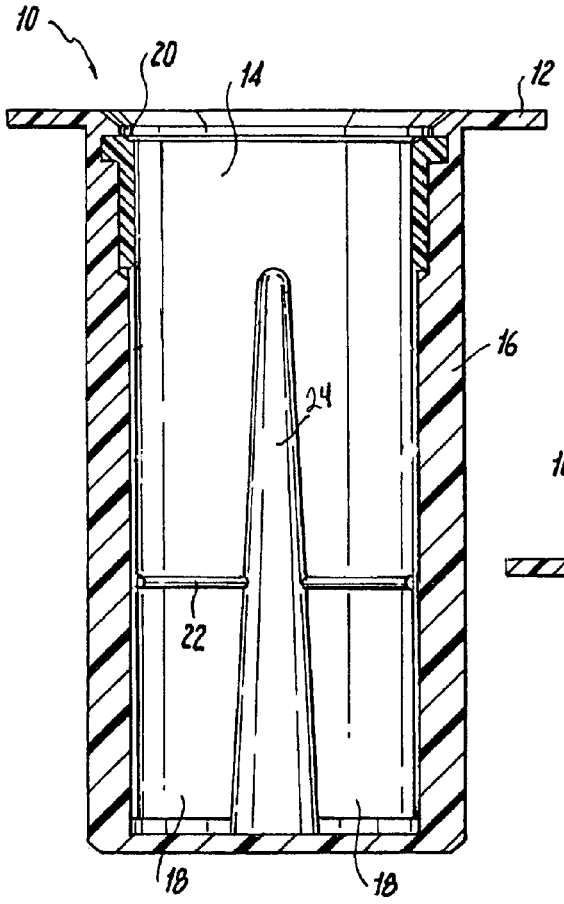
Fig. 4
Fig. 5
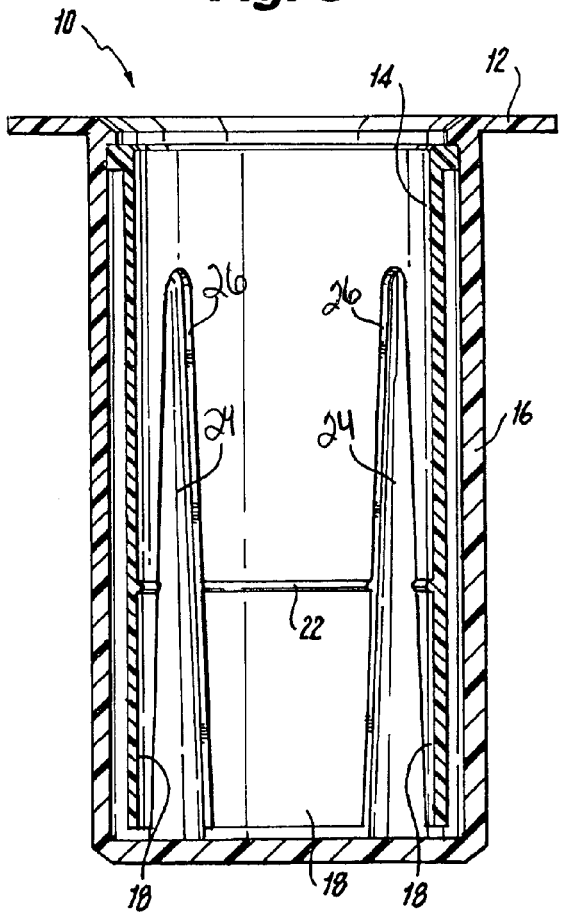

HAND DISPENSER FOR STRETCH WRAP

FIELD OF THE INVENTION

The present invention relates to a hand dispenser for stretch wrap or other flexible materials.

BACKGROUND OF THE INVENTION

U.S. Pat. No. 4,722,493 relates to a holder for dispensing stretch film from a roll comprising a cylindrical body and an arbor rotatably supported on the body. A flexible grip having internal ribs covers the body and the arbor, so that one can by applying finger pressure to the grip brake rotation of the arbor and thus control film tension. The patent teaches that the holder comprises a handle which includes a substantially cylindrical body and a shaft extending from one end of the body. An arbor is journaled on the shaft. Means on the arbor engage the film roll, thereby constraining the roll and the arbor to rotate together on the shaft. A collar is on the arbor adjacent the handle body. One holding the handle body may create a braking torque on the roll by applying radial pressure to the collar.

U.S. Pat. No. 5,203,517 relates to a dispenser for a stretch wrap film with cylindrical bearings. The dispenser has a spindle at the end which forms a hub which attaches to the core of the film roll and rotates with the roll as the film is unwound. The spindle extends coaxially from the core of the film roll and is partially surrounded by a flexible hand grip. Bearings are coaxially mounted on the spindle and interposed beneath part of the hand grip so that the spindle may rotate freely with respect to the hand grip. Part of the hand grip engages the spindle without interposition of bearings. The dispenser requires a first sleeve bearing mounted coaxially on the shaft adjacent the hub, a brake drum mounted coaxially on the shaft adjacent the first sleeve bearing, a second sleeve bearing mounted on the shaft adjacent the other end of the brake drum and a single flexible hand grip.

U.S. Pat. No. 4,575,020 relates to a portable chuck for dispensing under tension roll of wrapping material. The portable chuck includes an expandable spindle insertable within one end of the tubular core, and a handle for selectively expanding the spindle to create a braking force. The chuck is formed from first and second chuck pieces, each of which includes a spindle portion, collar and handle portion. A fulcrum means is disposed between the first and second chuck pieces above the collar.

U.S. Pat. No. 4,522,348 relates to a dispenser for stretch film having a manual braking mechanism. First and second side members are adjacent to each side of a roll wrapping material. Each of these side members has a bearing member disposed thereon for supporting the core. At least one of the bearing members is insertable into the core and has an expandable bearing surface.

U.S. Pat. No. 5,094,395 relates to an apparatus and method for dispensing plastic stretch film wherein a hollow core supply roll of stretch film is dispensed in a controlled manner utilizing a brake means mounted within the core. This urges by its own resiliency against the inside surface of the core while permitting frictionally retarded axially rotation of the core about the brake and having handles connected to the brake means.

U.S. Pat. No. 4,714,211 relates to a dispenser for applying plastic packaging film under tension about an object of large volume. The dispenser comprises a base with a handle and a roll support structure at opposite ends. The roll support structure comprises a tube that is adjustable relative to the base.

There is provided a means to secure the tube in a selected position, together with a tension applying means in connection with a hand grip attached to the upper end of the roll support structure.

U.S. Pat. No. 5,311,725 relates to a stretch wrap packaging machine which has a support frame and a rotatable frame rotatably mounted on the support frame. A dispenser is mounted on the rotatable frame to follow an orbital path. The dispenser has a web tensioning system. At least one actuation ring is mounted on the support frame. An activator moves the actuation ring to cooperate with the tensioning system.

U.S. Pat. No. 5,941,049 relates to a method and apparatus for stretch wrapping a load. A leading end of packaging materials is placed in a retainer to hold the leading end of the packaging material. Packaging material is dispensed from a packaging material dispenser, and relative rotation is provided between the dispenser and a load to wrap packaging material around the load. The packaging material is automatically released from the retainer in response to force applied by packaging material wrapped around the load or other unpowered actuation.

U.S. Pat. No. 4,102,513 relates to a dispenser for wrapping a roll of plastic stretch film under tension about an object. The dispenser has a reel assembly provided with an adjustable drag arrangement to set and adjust the tension on the film during the wrapping operation by the manipulation of a hand grip. Two hand grips are connected to and arranged relative to the reel assembly for the balance support thereof during wrapping. One hand grip is operatively associated with one of a pair of rotary end supports for the roll of film in such a way that movement of the one hand grip changes the drag on the roll and thereby the tension on the film during the wrapping thereof.

U.S. Design Pat. 317,394 and 382,429 relate to hand held dispensers for stretch wrap film.

U.S. Pat. No. 4,179,081 relates to an apparatus for the manual application of plastic stretch films to materials. The apparatus consists of an extended core for the supply of plastic stretch film and a pair of tubular like grip means for the extended core. The grip means serve as a manual control means for paying out the plastic stretch film and as a manual means for applying tension on the film. This patent requires a pair of flexible hand grips.

U.S. Pat. No. 4,248,392 relates to an apparatus for the application of plastic stretch films. The apparatus consists of a pair of insertable adaptors for the ends of a cylindrical core which hold a supply of plastic stretch film and a pair of tubular like grip means for the insertable adapters. This patent requires a pair of insertable adapters and a pair of flexible hand grips.

U.S. Pat. No. 4,477,037 relates to a stretch wrap film dispenser wherein the stretch wrap film is wound on a core which is longer than the roll of film to extend out of both ends. A rotatable handle is mounted on the core outboard of the film. Relative brake nib between the handle and core is adjusted by a screw thread.

U.S. Pat. No. 4,484,717 relates to a stretch wrap film dispenser with single digit tension control. A brake ring under at least one index finger can be clamped by that finger under the spindle to apply braking.

U.S. Pat. No. 4,817,762 relates to a dispenser handle for rolls of flexible sheet material. The handle includes a spindle carrying at one end locking means insertable into the overside opening of a hollow cylindrical core on which the sheet material is wound. The spindle is of reduced diameter and carries a collapsible sleeve which the operator may squeeze to brake the spindle and hence the rate at which the material is stripped from the roll.

U.S. Pat. No. 5,915,642 relates to a dispenser handle for rolls of flexible sheeting material. The handle has an insert portion having a plurality of radially extending fins and a grip surface. The handle is inserted into a hollow core. The fins provide a fit that allows the core to rotate relative to the handle. The fins can deform when subjected to such rotation. The grip is positioned to allow the user to squeeze the handle against the core to slow or stop the rotation.

D 612,179 relates to a stretch film dispenser.

U.S. Pat. No. 7,726,600 relates to a stretch film dispenser which includes a base, a reel device, and a brake device. The reel device has a reel and a connecting member pivotally connected to the base, and the brake device is connected to the base and is fitted to the connecting member of the reel device. The base and the brake device form a holding member of the stretch film dispenser to be grasped by the user.

US patent publication 2009/0050729 relates to a stretch film dispenser which includes a base, reel and two brake devices. The reel is connected to the base for rotation. The brake devices are connected to two flexible members on an outer annular wall of the base to be pressed for braking the reel.

US patent publication 2009/0309968 relates to a push-to-expand mandrel for stretch wrap hand tool. The invention relates to a dispenser for use with coreless rolls. The mandrel can move between a retracted position and an increased diameter position.

U.S. Pat. No. 4,535,951 relates to a stretch film wrapping device for supporting a roll of plastic film having a tubular rigid core which includes a pair of opposed core holders interconnected by a length of adjustable axle member to effect clamping of the film roll between core holders. The bottom core holder is mounted on a base member. The top core holder is mounted on the axle member.

SUMMARY OF THE INVENTION

The present invention relates to a film dispenser, and the film dispenser and the extended core in combination. The film dispenser comprises an outer mold and a separate inner mold. The outer mold comprises a collar and inner ribs. The inner mold is comprised of slots, extensions and inner ridges.

The outer mold is made of a material with a high coefficient of friction compared to the extended core of the film wrap. The inner mold has a lower coefficient of friction compared to the outer mold. When squeezed the outer mold touches the extended core through the slots of the inner mold. This causes additional friction which, when increasing the amount of force applied to the outer mold, slows down and stops the extended core from spinning and dispensing film. The low coefficient of friction between the inner mold and the extended core allows the extended core to turn and release the film when the squeezing force is reduced and the outer mold no longer touches the core.

It is an object of the present invention for the inner mold to comprise a collar which locks the inner mold within the outer mold. The inner mold further comprises slots, extensions and inner ridges located between the slots on the extensions. The ridges fit into a groove formed in the extended core and lock the film dispenser onto the extended core.

The outer mold has ribs which fit into the slots of the inner mold and keep the inner mold in place. These ribs, assist in braking when a force is applied to the film dispenser.

When dispensing the film the user holds the film dispenser and the extended core turns releasing the film. By varying the grip force on the dispenser, the user can control the braking action of the dispenser and thus the tension of the film. Squeezing the dispenser sufficiently so that the ribs of the outer mold come in contact with the core rapidly increases the braking force and enables the user to completely stop the dispensing of the film. Thus, the dispenser provides the user with accurate tension control from free spinning the dispenser to stopping the dispensing of the film completely by simply increasing the gripping force on the dispenser.

The collar of the outer mold keeps the hand of the user off the edge of the roll as it unwinds.

It is an object of the present invention for the stretch film from the hand dispenser to be dispensed by using one hand from a person. It is an object of the present invention for the hand dispenser to comprise a separate inner and outer mold.

It is an object of the present invention to slide a roll of stretch wrap onto the dispenser and have the roll of film to snap into place.

It is an object of the present invention for a small amount of tension to activate the films holding power.

It is an object of the present invention for the film dispenser to be reusable.

It is an object of the present invention for the film dispenser to be easily removed from the device.

It is an object of the present invention for the dispenser unit to allow a manufacturer of roll goods to wind a spiral of stretch film about the roll and around the ends of the goods.

It is an object of the present invention for the unit to have a manually operable braking system that is adjustable to permit the application with braking tension over a wide range.

It is an object of the present invention for the tension in the film to be controllable during the wrapping process.

It is an object of the present invention to provide a stretch wrap dispenser which has good balance and facilitates the application of film under substantially uniform tension across the full width of the film for a uniform wrap.

It is an object of the present invention to provide a stretch wrap film dispenser wherein the roll is easily replaced.

It is an object of the present invention to provide a stretch wrap film dispenser which can be adjusted to accommodate different widths of film rolls.

It is an object of the present invention to provide an extended core on both sides of the film, and to provide the film dispenser on both sides of the film so the film can be applied by using two hands.

It is an object of the present invention for the extensions of the inner mold to be flexible. This allows the ridges of the inner mold to snap into the groove of the extended core.

BRIEF DESCRIPTION OF THE DRAWINGS

FIG. 4 shows a cross sectional view of the device of FIG. 1 through lines AA.

FIG. 5 shows a cross sectional view of the device of FIG. 1 through lines BB.

DETAILED DESCRIPTION OF THE INVENTION

Figure 1:
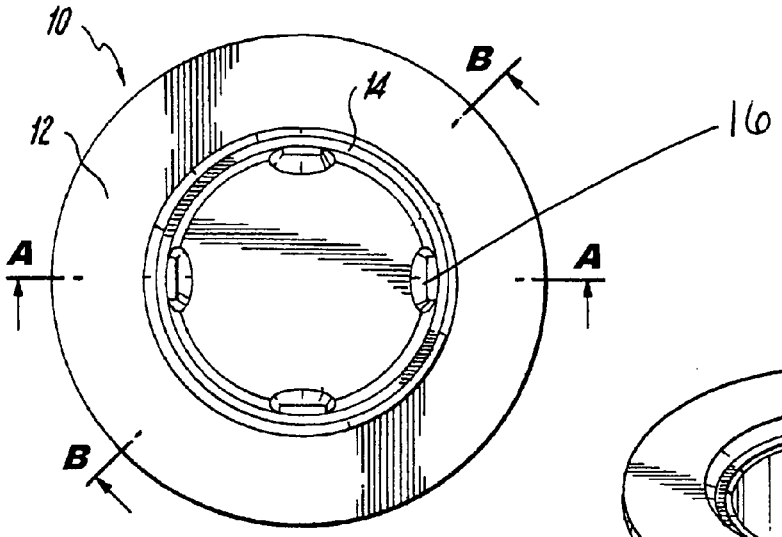
FIG. 1 illustrates a top view of the device of the present invention.

FIG. 1 is a top view of a film dispenser. The film dispenser 10 has a collar 12, an inner mold 14 and an outer mold 16.

Figure 2:
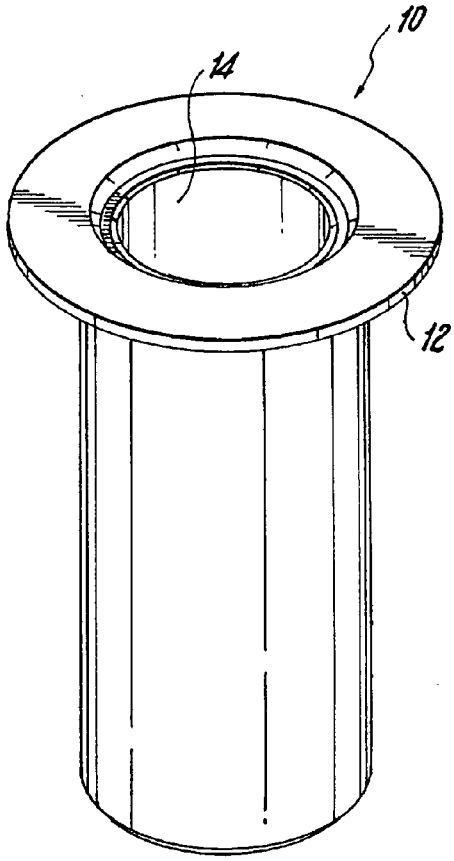
FIG. 2 illustrates a side view of the device of the present invention.

FIG. 2 shows the side view of the film dispenser 10 having a collar 12.

Figure 3:
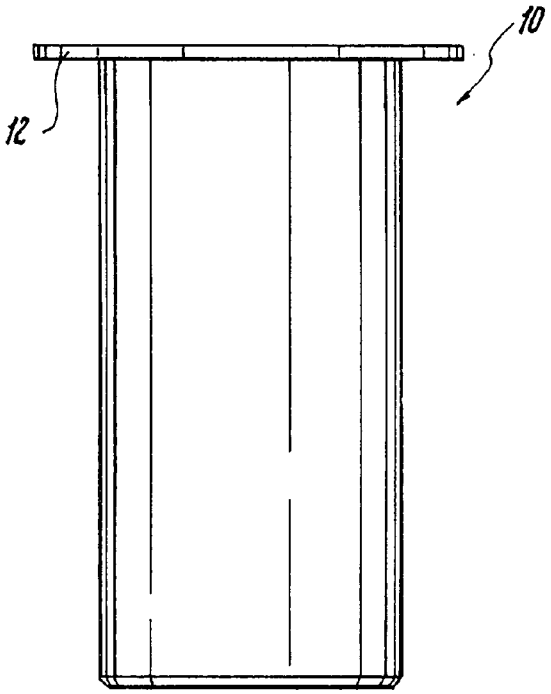
FIG. 3 illustrates a side view of the device of the present invention.

FIG. 3 shows a side view of the film dispenser 10 having a collar 12.

FIG. 4 shows a cross sectional view through line AA of FIG. 1 which is a cross section through the ribs 26 in the outer mold 16. The film dispenser 10 has a collar 12. The inner mold 14 comprises extensions 18. The inner mold 14 has a collar 20 which allows it to lock within the outer mold 16. The inner mold further comprises ridges 22 which fit into a groove 36 formed in the extended core 30 when the extended core 30 is placed within the film dispenser 10. The inner mold 14 further comprises slots 24 which are located between the extensions 18.

FIG. 5 shows a cross sectional view of the film dispenser 10 through line BB in FIG. 1 which is a cross section not through the ribs 26 of the outer mold 16. FIG. 5 shows the inner mold 14 having three extensions 18 and two slots 24.

Figure 6:
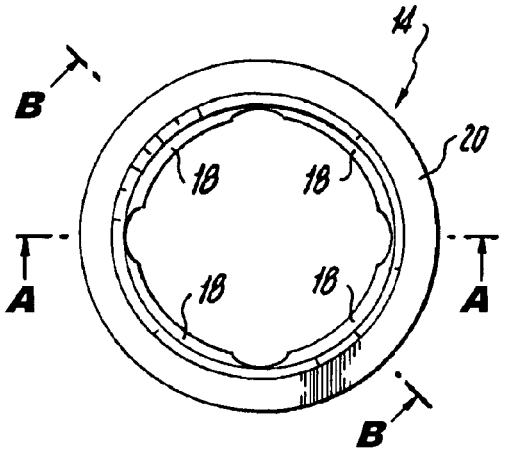
FIG. 6 shows a top view of the inner mold of the device.

FIG. 6 shows a top view of the inner mold 14.

Figure 7:
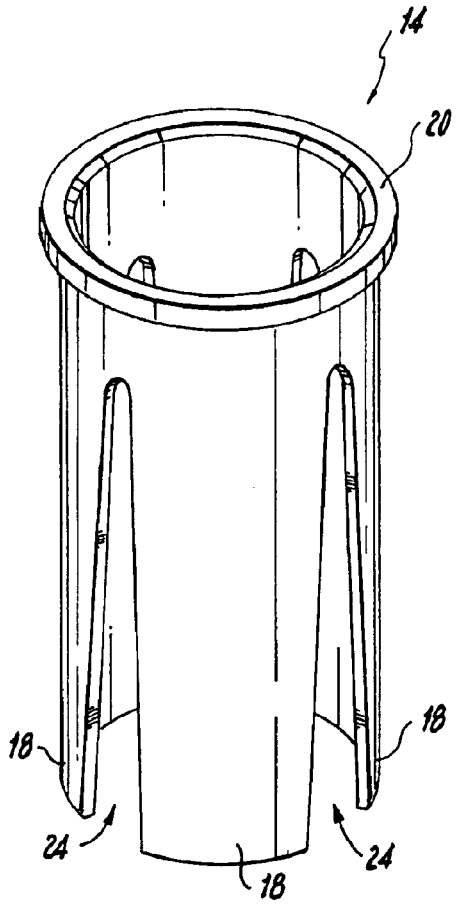
FIG. 7 shows a side view of the inner mold of the device.

FIG. 7 shows a side view of the inner mold 14 having a collar 20, extensions 18, slots 24 and a ridge 22.

Figure 8:
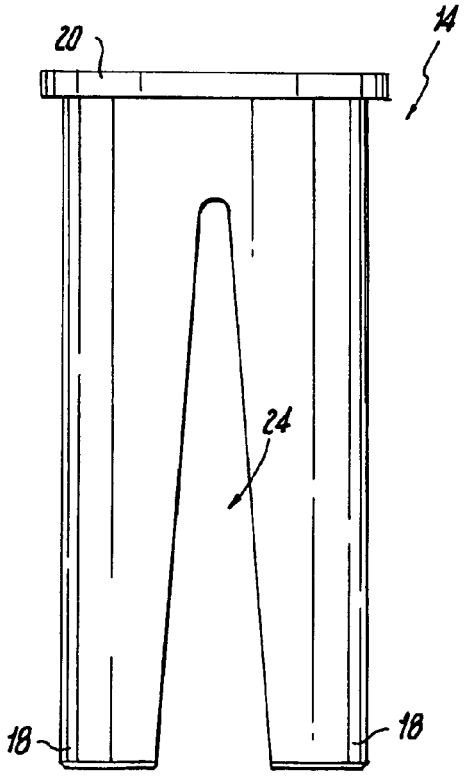
FIG. 8 shows a side view of the inner mold of the device.

FIG. 8 shows a side view of the inner mold 14 having extensions 18 and a slot 24.

Figure 9:
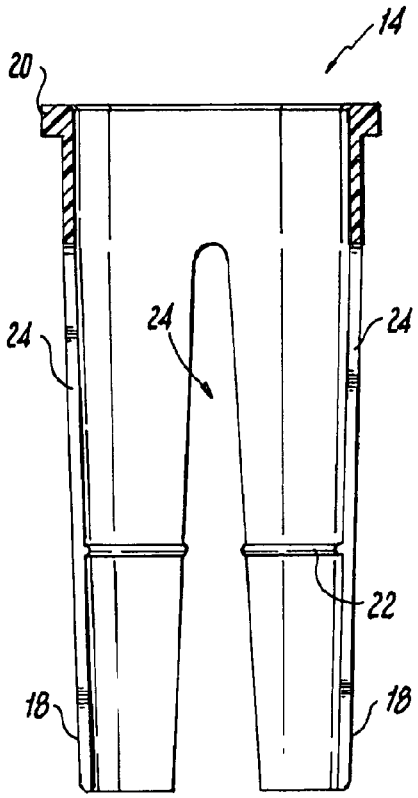
FIG. 9 shows a cross sectional view of the inner mold of FIG. 6 through lines AA.

FIG. 9 shows a cross sectional view of the inner mold 14 through line AA which is through the slots 24 shown in FIG. 6. FIG. 9 shows the collar 20, extensions 18, slot 24 and ridge 22.

Figure 10:
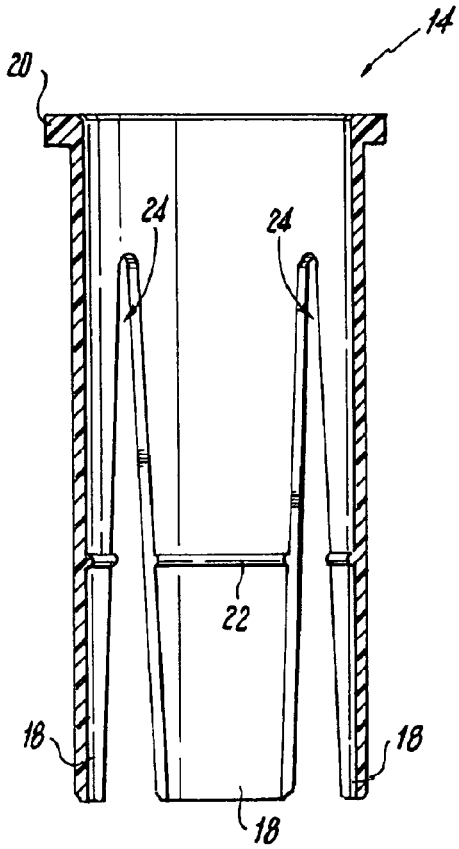
FIG. 10 shows a cross sectional view of the inner mold of FIG. 6 through lines BB.

FIG. 10 shows a cross sectional view of the inner mold 14 through line BB in FIG. 6, which is through the extensions 18. FIG. 10 shows the collar 20, extensions 18, slots 24, and ridge 22.

Figure 11:
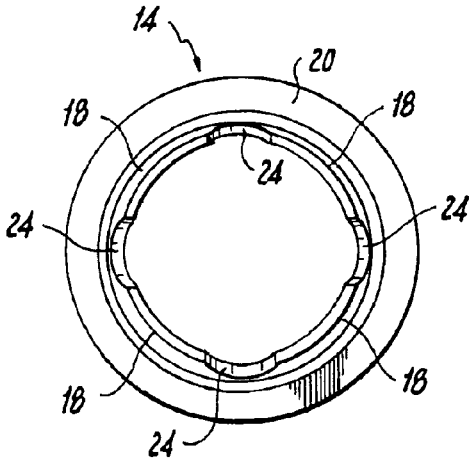
FIG. 11 shows a top view of the inner mold of the device.

FIG. 11 shows a top view of the inner mold 14 having extensions 18.

Figure 12:
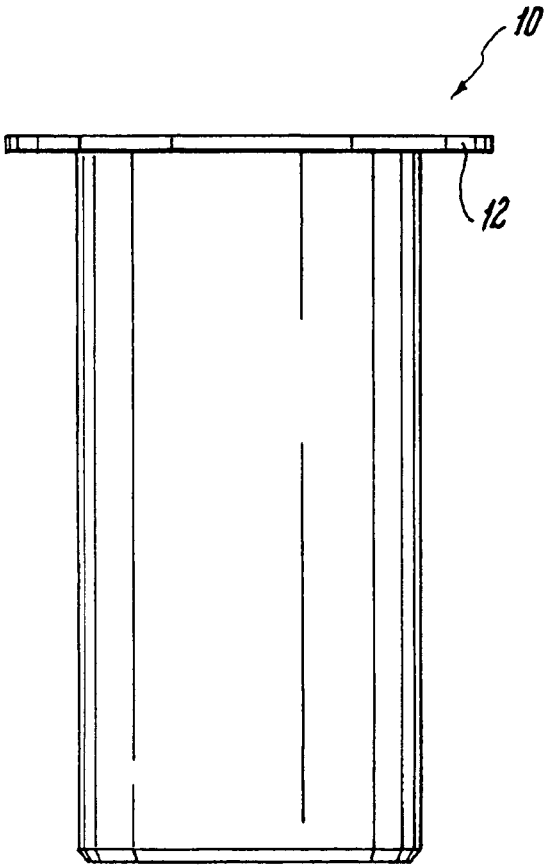
FIG. 12 shows a side view of the device.

FIG. 12 shows a side view of the film dispenser 10 having a collar 12.

Figure 13:
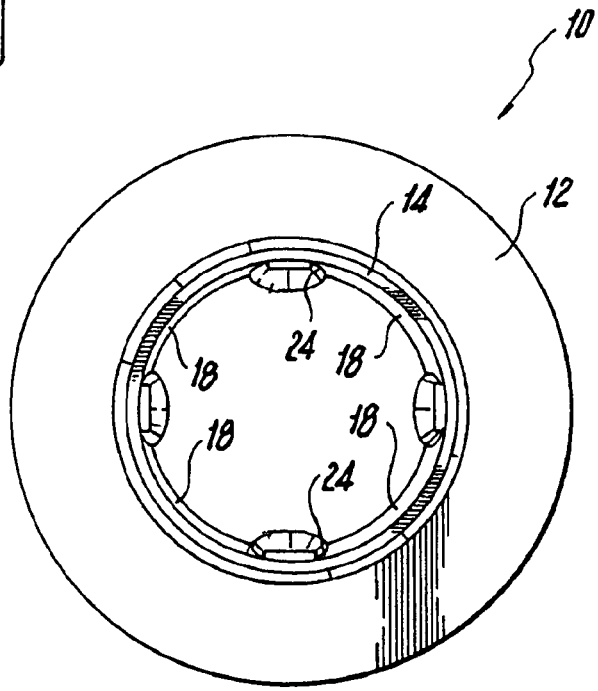
FIG. 13 shows a top view of the device.

FIG. 13 shows a top view of the film dispenser 10 having a collar 12, an inner mold 14, extensions 18 and slots 24.

Figure 14:
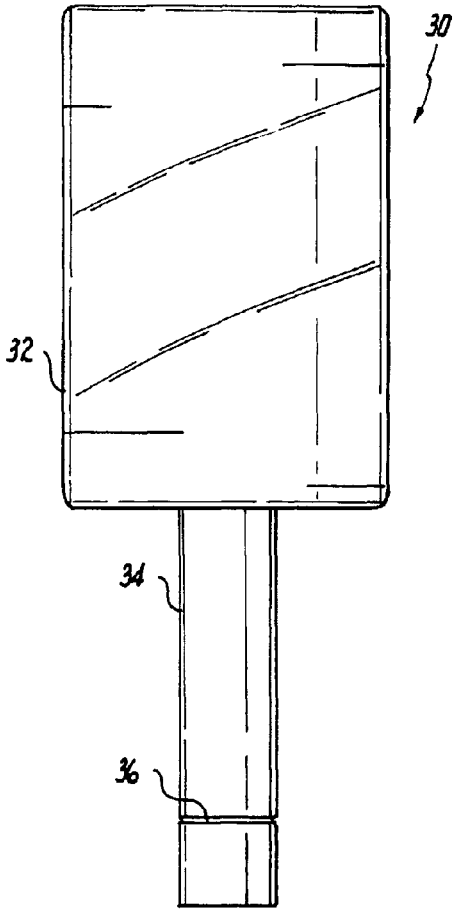
FIG. 14 shows a side view of the extended core and film without the film dispenser.

FIG. 14 shows the extended core 30 having film 32 wound around a roll 34, the roll having a groove 36 which when placed in the film dispenser 10 of the present invention where the ridge 22 fits into the groove 36 to keep the extended core 30 in place.

Figure 15:
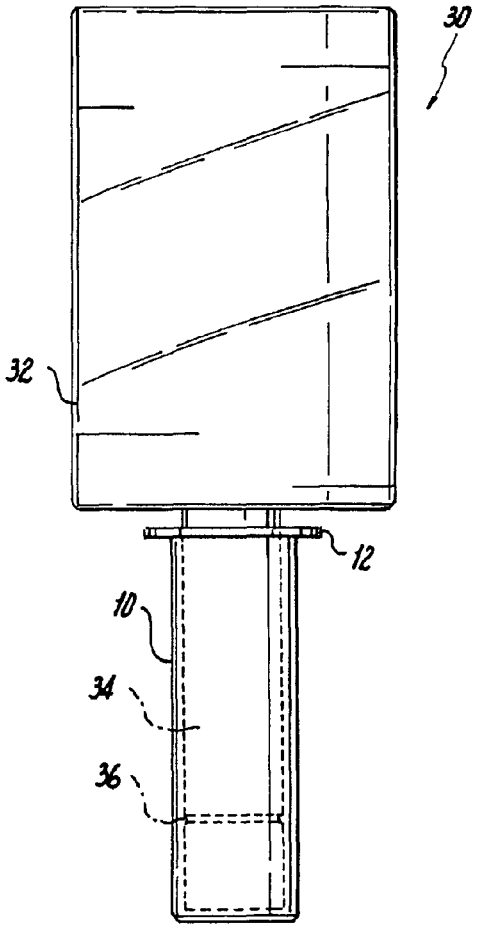
FIG. 15 shows a side view of the extended core and the film on the film dispenser.

FIG. 15 shows the extended core 30 within the film dispenser 10.

Figure 16:
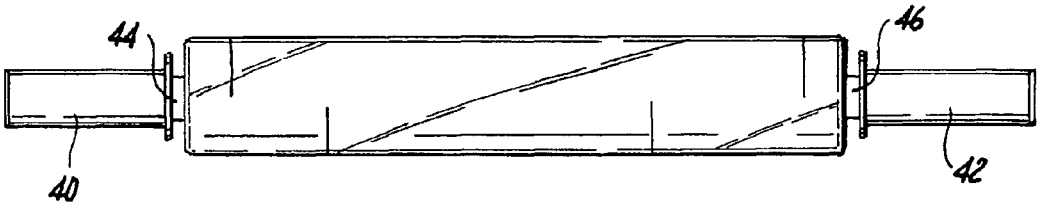
FIG. 16 shows a side view of an embodiment of the film dispenser.

FIG. 16 shows film dispensers 40 and 42 having extended cores 44 and 46 within the respective film dispensers.

When dispensing the film the user holds the film dispenser 10 and the extended core turns releasing the film. When the user wishes to end the dispensing of film, the user grips the film dispenser firmly which then provides resistance to the extended core which is inside the film dispenser. This provides a braking motion which stops the dispensing of the film. This acts as a brake by increasing the friction between the film dispenser and the extended core.

The collar 12 keeps the hand of the user off the edge of the roll as it unwinds.

In a preferred embodiment, the outer mold is made of a material with a high coefficient of friction compared to the extended core of the film wrap. The inner mold has a lower coefficient of friction compared to the outer mold. When squeezed the outer mold touches the extended core through the slots of the inner core. This causes additional friction which, when increasing the amount of force applied to the outer mold, slows down and stops the extended core from spinning and dispensing film. The low coefficient of friction between the inner mold and the extended core allows the extended core to turn and release the film when the squeezing force is reduced and the outer mold no longer touches the core.

The invention claimed is:

1. A film dispenser for stretch wrap comprising:
- a film dispenser;
- said film dispenser comprising:
- an inner mold and an outer mold;
- an extended core;
- said inner mold comprised of slots and extensions;
- said outer mold comprising ribs which fit into said slots of said inner mold;
- wherein said outer mold has a higher coefficient of friction than said inner mold.

2. The film dispenser of claim 1 wherein said inner mold further comprises a collar.

3. The film dispenser of claim 2 wherein said collar allows said inner mold to sit within said outer mold.

4. The film dispenser of claim 1 wherein said inner mold further comprises a ridge which fits into a groove formed in said extended core when said extended core is placed within said film dispenser.

5. The film dispenser of claim 4 wherein said extensions of said inner mold are flexible, allowing ridges of said inner mold to snap into said groove of said extended core.

6. The film dispenser of claim 4 wherein said outer mold has a high coefficient of friction compared to said extended core.

7. The film dispenser of claim 6 wherein when said outer mold is squeezed it touches said extended core through said slots of said inner mold, causing friction which, slows down or stops said extended core from spinning and dispensing film.

8. The film dispenser of claim 6 wherein low coefficient of friction between said inner mold and said extended core allows said extended core to turn and release said film.

9. The film dispenser of claim 1 wherein said ribs of said outer mold fit into said slots of said inner mold keeping said inner mold in place, and assisting in braking said dispenser when a force is applied to said film dispenser.

10. The film dispenser of claim 1 wherein said outer mold comprises a collar.

11. A combination film dispenser and extended core comprising:
- a film dispenser;
- said film dispenser comprising an inner mold and an outer mold;
- said inner mold comprised of slots and extensions;
- said outer mold comprising ribs which fit into said slots of said inner mold;

said inner mold having a ridge within it;

a film wound around an extended core;

said extended core having a groove which when placed in said film dispenser and into said ridge holds said extended core in said film dispenser.

12. The film dispenser and extended core of claim 11 wherein when dispensing said film a user holds said film dispenser and said extended core turns releasing said film.

13. The film dispenser and extended core of claim 11 wherein when user wishes to end dispensing of said film, said user grips said film dispenser firmly which then provides resistance to said extended core which is inside said film dispenser.

14. The film dispenser and extended core of claim 11 wherein said film from said extended core is dispensed by using one hand from a person.

15. The film dispenser and extended core of claim 11 wherein said extended core slides into said film dispenser and snaps into place.

16. The film dispenser and extended core of claim 11 wherein said film dispenser is reusable.

17. The film dispenser and extended core of claim 11 wherein said film dispenser and extended core have a manually operable braking system that is adjustable.

18. The film dispenser and extended core of claim 11 wherein tension in said film is controllable during wrapping process.

19. A combination film dispenser and extended core comprising:

two film dispensers;

each film dispenser comprising an inner mold and an outer mold;

each inner mold comprised of slots and extensions;

each outer mold comprising ribs which fit into said slots of said inner mold;

each inner mold having a ridge within it;

a film wound around an extended core;

said extended core protruding from both ends of said film creating two extended cores;

said extended cores each having a groove which when placed in said film dispensers and into said ridges hold said extended cores in said film dispensers.

20. The combination film dispenser and extended core of claim 19 wherein said film is dispensed using two hands.

* * * * *